US005083703A

United States Patent [19]

Blyakharov

[11] Patent Number: 5,083,703

[45] Date of Patent: Jan. 28, 1992

[54] MAILBOX

[76] Inventor: Ayzik Blyakharov, 31-41 23 St. #7N, Astoria, N.Y. 11102

[21] Appl. No.: 407,219

[22] Filed: Sep. 14, 1989

[51] Int. Cl.[5] ..... B65D 91/00

[52] U.S. Cl. ..... 232/17; 211/88

[58] Field of Search ..... 232/17, 19, 20, 27, 232/1 E; 211/88; D6/536, 540

[56] References Cited

U.S. PATENT DOCUMENTS

| | | | |
|---|---|---|---|
| 838,194 | 12/1906 | Larsh | 232/17 |
| 1,494,181 | 5/1924 | Morris | 232/17 X |
| 2,532,134 | 11/1950 | Wiedman | 232/19 |
| 4,372,480 | 2/1983 | Mitchell et al. | 232/17 |
| 4,714,192 | 12/1987 | Harlow et al. | 232/17 |

*Primary Examiner*—Robert W. Gibson, Jr.
*Attorney, Agent, or Firm*—Ilya Zborovsky

[57] ABSTRACT

A mailbox has a container with an inner chamber, and a hollow insert movable in said chamber between an inserted position in which the insert is located inside the container and an extended position in which at least a portion of the insert is located outside of the container and exposed to a user.

6 Claims, 2 Drawing Sheets

MAILBOX

BACKGROUND OF THE INVENTION

The present invention relates to mailboxes for receiving and discharging mail.

Maiboxes are known and used in a great variety of shapes and designs. In apartment buildings the mailboxes are arranged in a multi-structure unit which includes several maiboxes or several dozens mailboxes. In such structures there are lower and upper rows of mailboxes, and their use has certain disadvantages. People with a low height cannot reach the level of the upper rows, they do not see what is inside the upper row boxes and just put their arms into the mailbox to remove the mail. Sometimes, they miss the mail and it is left in the mailbox. It is also difficult to see the interior of the lower row mailboxes, especially for tall people. It is necessary to bend downwardly in an attempt to see the inner space of the lower row mailboxes. In many instances, the users do not bend down and just remove the mail by hand, which again might lead to some mail remaining in the lower row mailboxes.

SUMMARY OF THE INVENTION

Accordingly, it is an object of the present invention to provide a mailbox which avoids the disadvantages of the prior art.

More particularly, it is an object of the present invention to provide a mailbox which makes easier the observation of its interior for people of all heights.

In keeping with these objects and with others which will become apparent hereinafter, one feature of the present invention resides, briefly stated, in a mailbox which has a hollow container and a hollow insert for receiving mail and movable between an inserted position in which it is located inside of the container and an extended position in which it is located at least partially outside of the container to expose mail accommodated therein.

In accordance with an advantageous feature of the present invention, in the extended position the insert is inclined relative to the container downwardly.

The novel features of the present invention are set forth in particular in the appended claims.

The invention itself, however, both as to its construction and its manner of operation, will be best understood from the following description of a preferred embodiment which is accompanied by the following drawings.

DESCRIPTION OF A PREFERRED EMBODIMENT

Figure 1:
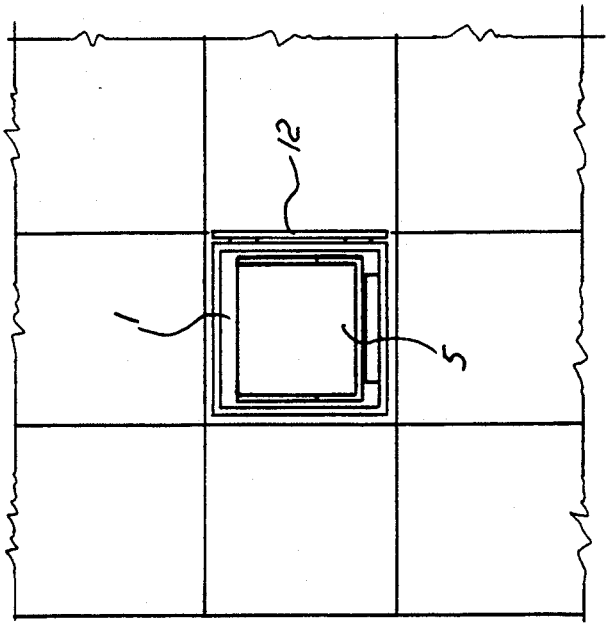
FIG. 1 is a view showing a multi-box structure with a plurality of mailboxes.

A mailbox in accordance with the present invention has a hollow container which is identified with reference numeral 1 and has an inner chamber 2. At one end, the container 1 has an inlet opening 3. A small vertical projection 4 is located near the opening 3.

The mailbox further includes an insert which is identified with reference numeral 5. The insert is hollow and has a rear wall 6, a front open end 7, and two side walls 8. At least a front portion of each wall 8 is inclined in direction toward the opening 7. The insert 5 is formed as a tray-shaped element. A bottom wall 9 of the insert 5 is provided with a small projection 10. The height of the projection 10 is at least equal to the height of the projection 4.

The mailboxes in accordance with the present invention can be assembled into a multi-box structure 11 shown in FIG. 1. It is to be understood that the inventive mailbox can also be used individually. Both arrangement in general are well known in the art.

It is to be understood that the front opening 3 of the mailbox or more particularly of the container 1 can be closeable and openable by a door 12 of a known construction.

Figure 4:
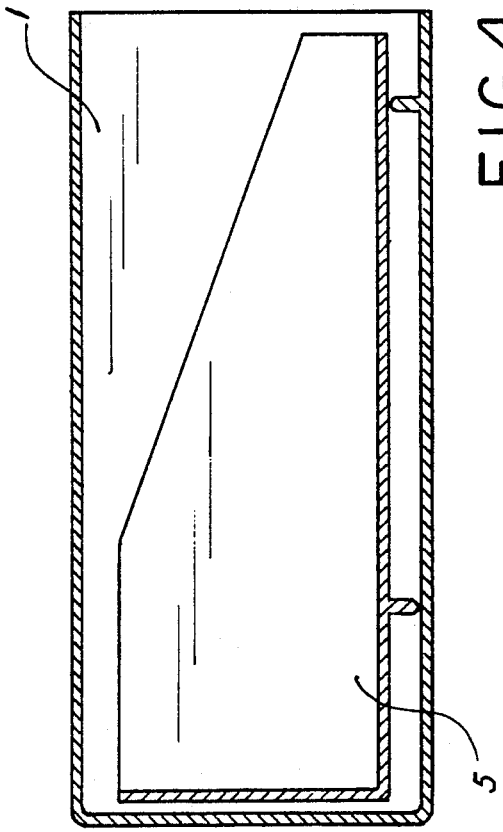
FIG. 4 in a view showing the inventive mailbox with the insert in an inserted position.

The mailbox in accordance with the present invention operates in the following manner. In a normal inserted position shown in FIG. 4 the insert 5 is located inside the container 1. Due to the height ratio between the projections 4 and 10 the insert extends substantially horizontally; at least, it is not inclined rearwardly. A mailman opens the door and puts a mail into the mailbox, or more particularly, into the interior of the insert 5. When a user wants to take the mail, he opens the door and pulls the insert forwardly so that it assumes the extended position shown in FIG. 5. In this position a portion of the insert is located outside of the container and can be easily observed. Moreover, the insert is inclined downwardly toward the user, thus further facilitating the ibservation of its interior. It is no longer necessary to stretch up toward upper rows of mailboxes or bend downwardly toward the lower rows of mailboxes. In the extended position of the insert, the user removes the mail. Moreover, since the insert is inclined, the mail automatically slides over the bottom wall of the insert toward the user. After the removal of the mail, the user pushes the insert back into the container to its inserted position and closes the door.

It is to be understood that a mailman can put the mail into the insert also in the extended position of the latter, which facilitates the mailman's work as well.

Figure 5:
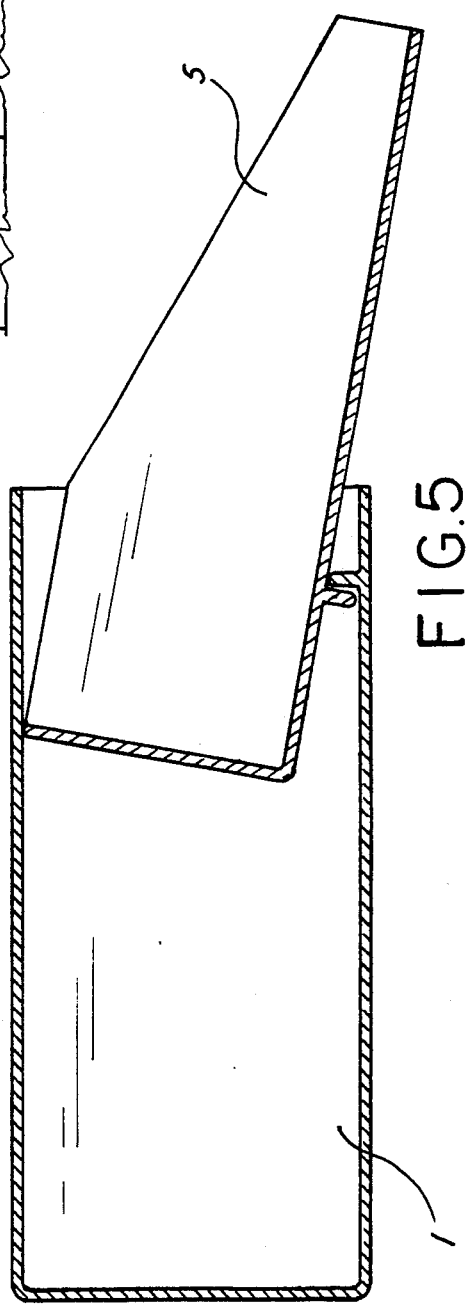
FIG. 5 is a view showing the inventive mailbox with the insert in an extended position.
Figures 2, 3:
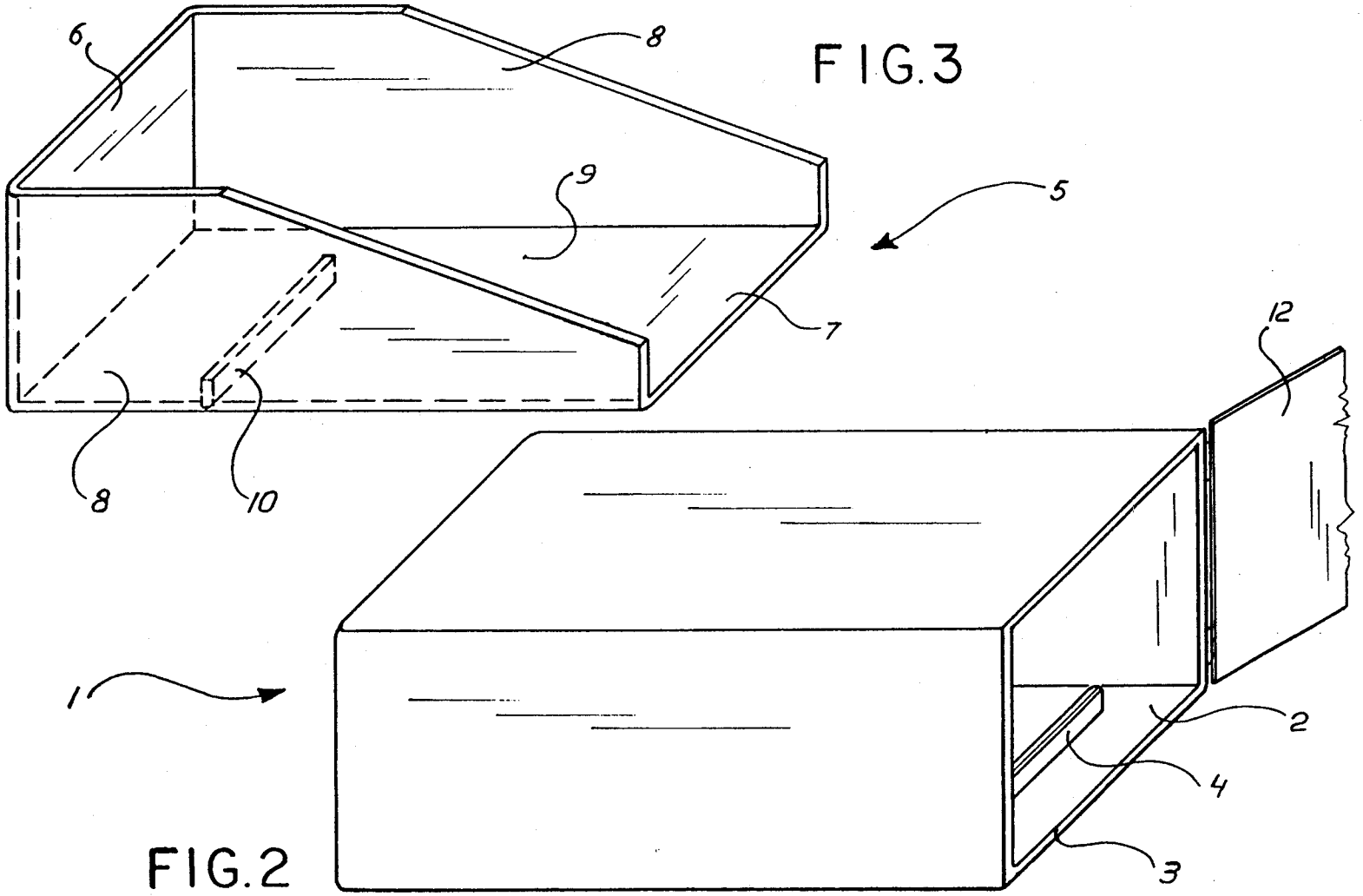
FIG. 2 is a view showing a container of a mailbox in accordance with the present invention.
FIG. 3 is a view showing an insert part of a mailbox in accordance with the present invention.

As can be seen from FIG. 5 in the extended position of the insert its upper edge abuts from below against the top wall of the container. This also prevents an unauthorized sliding of the insert outwardly of the container. The interengagement of the projections 4 and 10 in the extended position of the insert makes the retention of the insert in the container even more reliable. If desired, however, the projections can be dispensed with, and the insert is designed with such a height as to be reliably held inside the container as a result of the above mentioned abutment of its upper edge against the top wall of the container.

The invention is not limited to the details shown since various modifications and structural changes are possible without departing in any way from the spirit of the present invention.

What is desired to be protected by Letters Patent is set forth in particular in the appended claims.

I claim:

1. A mailbox, comprising a hollow container having an inner chamber with an outlet opening and a bottom wall with a first projection located near said opening; and a hollow insert formed to accommodate mail and movable in said chamber between an inserted position in which said insert is located inside said chamber and an extended position in which said insert is located at least partially outside of said container so as to expose an interior of said insert, said insert having a bottom wall provided with a second projection engageable in said extended position with said first projection of said container so as to retain said insert in said chamber of said container in said extended position without said insert being connected with said container.

2. A mailbox as defined in claim 1, wherein said insert is formed so that in said extended position it is inclined downwardly relative to said container.

3. A mailbox as defined in claim 1, wherein said container has a top wall, said insert having an upper edge and formed so that in said extended position said upper edge of said insert abuts against said top wall of said container from below.

4. A mailbox as defined in claim 1, wherein said first projection has a predetermined height, said second projection having a height which is at least equal to the height of said first projection.

5. A mailbox as defined in claim 1, wherein said insert has two side walls and two ends spaced from one another, at least a portion of each of said side walls being inclined.

6. A mailbox as defined in claim 5, wherein said ends include a rear end and a front end, said insert being provided with a vertical wall at said rear end, while said front end is open.

* * * * *